United States Patent [19]

Schröter

[11] 4,101,918

[45] Jul. 18, 1978

[54] DEVELOPING APPARATUS FOR LIGHT-SENSITIVE MATERIALS COMPRISING AN EVAPORATOR FOR EVAPORATING A DEVELOPER MEDIUM FROM A SOLUTION

[75] Inventor: Herbert Schröter, Taunusstein, Germany

[73] Assignee: Hoechst Aktiengesellschaft, Germany

[21] Appl. No.: 745,980

[22] Filed: Nov. 29, 1976

[30] Foreign Application Priority Data

Nov. 29, 1975 [DE] Fed. Rep. of Germany ..... 2553769

[51] Int. Cl.[2] ..... G03D 13/00

[52] U.S. Cl. ..... 354/299; 354/300; 354/324

[58] Field of Search ..... 354/299, 300, 324, 325, 354/326, 331, 333, 336; 134/64 P, 122 P

[56] References Cited

U.S. PATENT DOCUMENTS

| | | | |
|---|---|---|---|
| 2,009,962 | 7/1935 | Kurten | 354/300 |
| 2,047,104 | 7/1936 | Morse | 354/299 |
| 2,562,588 | 7/1951 | Traiber | 354/324 |
| 3,147,687 | 9/1964 | Halden | 354/300 |
| 3,475,165 | 7/1949 | Trump | 354/300 |
| 3,613,547 | 10/1971 | Snarr | 354/324 |
| 3,851,662 | 12/1974 | Jessop | 354/324 |

FOREIGN PATENT DOCUMENTS

| | | | |
|---|---|---|---|
| 989,227 | 5/1976 | Canada | 354/331 |

*Primary Examiner*—L. T. Hix
*Assistant Examiner*—Alan Mathews
*Attorney, Agent, or Firm*—James E. Bryan

[57] ABSTRACT

This invention relates to a developing apparatus for light-sensitive material comprising elongated open trough means, partition means in said trough means dividing said trough means into sections, means providing communication between said sections, inlet and outlet means for said trough means, said inlet means being adapted to introduce solution into one of said sections and said outlet means being adapted to remove solution from another of said sections, heating means in said section containing said outlet means and being positioned below an opening of said outlet means in said trough means, and temperature sensor means connected to said heating means via thermostat means.

6 Claims, 1 Drawing Figure

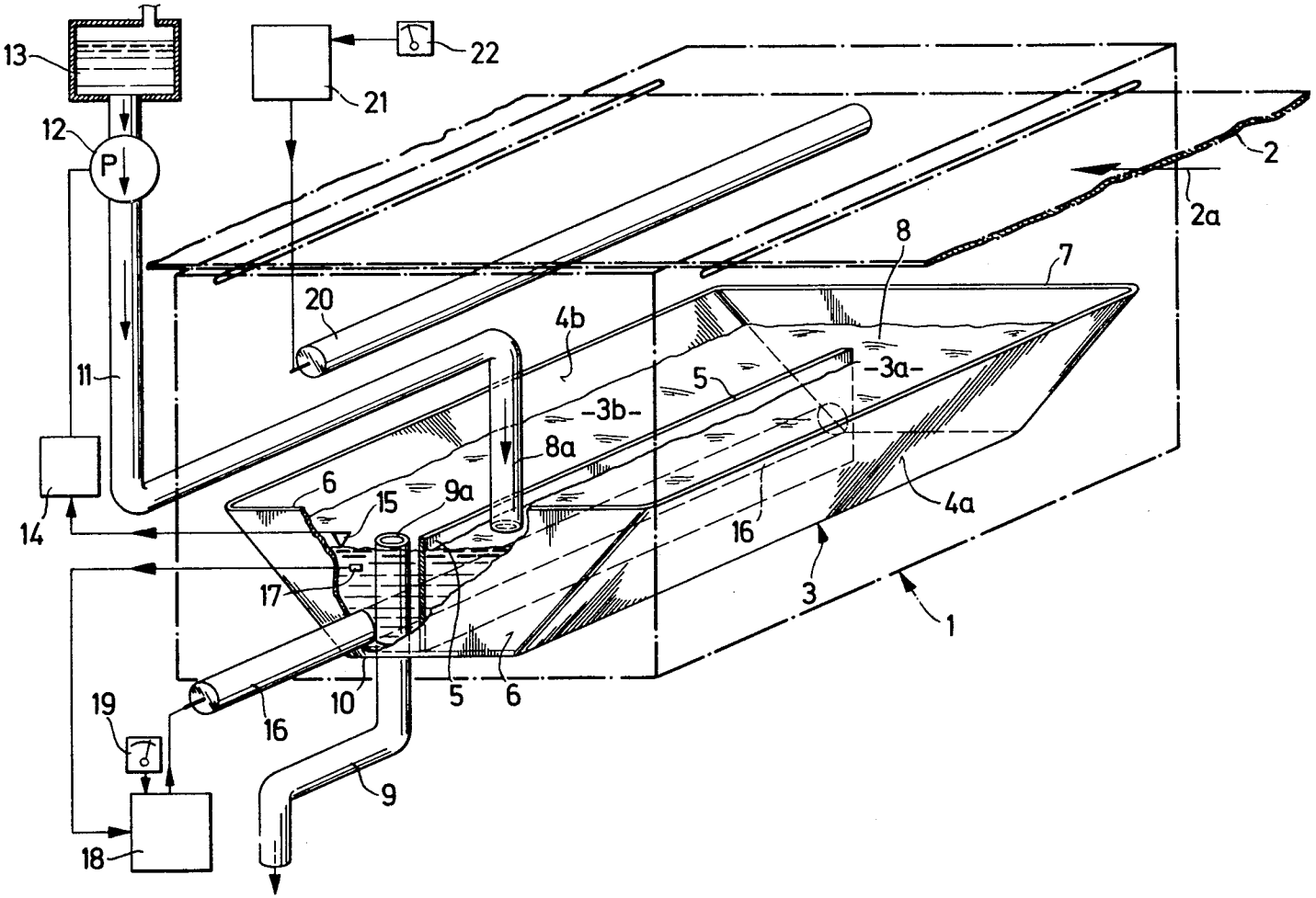
1
2
2a
3
3a
3b
4a
4b
5
6
7
8
8a
9
9a
10
11
12
13
14
15
16
17
18
19
20
21
22
P

DEVELOPING APPARATUS FOR LIGHT-SENSITIVE MATERIALS COMPRISING AN EVAPORATOR FOR EVAPORATING A DEVELOPER MEDIUM FROM A SOLUTION

This invention relates to a developing apparatus for light-sensitive materials which comprises an evaporator for evaporating a developer medium from a solution.

In a known developing apparatus of this type (German Offenlegungsschrift No. 2,309,851), the device used for evaporating the developer medium comprises a horizontally arranged heating rod surrounded by two concentric tubes with closed ends. The tubes form two chambers which open along a slot in the upper portions thereof. The outer tube is provided with at least one inlet, whereas the inner tube is provided with at least one outlet for the solution. There is at least one connection between the chambers or compartments, which allows the solution to pass from the outer to the inner chamber. The heating rod used preferably is one with a controllable heat output.

It is the object of this prior art apparatus to generate gaseous developer as uniformly as possible and to avoid a sudden heating of the developer solution from which the developer medium is generated, in order to avoid spattering. For this purpose, the developer solution is not immediately heated to the temperature required for evaporation, but is slowly heated in the chambers, from the inlet to the outlet.

Further, German Pat. No. 888,364, discloses a developing device for photoprints which comprises an evaporating chamber and a trough for generating developer vapors and a device for feeding developer liquid to the trough. The trough is molded from sheet metal and comprises two channels with V-shaped cross-sections which extend more or less parallel to each other. The width and depth of the two channels increase from one end thereof to the other in such a manner that the cross-sections of the channels increase in opposite directions. In this manner, a gradient for the developer liquid is created. The two channels are equipped with heating tubes which extend in the longitudinal direction of the channels. Developer liquid is introduced at the narrow, raised end of each channel, and each channel is fed by a separate tube. The arrangement and design of these channels serve the purpose of ensuring that the developer liquid is completely evaporated, that vapor is generated in as uniform a quantity as possible, and is distributed in the developing chamber as evenly as possible. For this purpose, a bucket conveyor feeds the liquid to the troughs in quantities which may be adjusted to constant values. The quantity of liquid to be introduced is controlled by the manual setting of curves which cause the buckets to incline at different angles so that the full buckets are emptied to varying degrees. The residual quantity contained in the buckets is fed to the troughs through tubes and corresponds to the quantity of developer liquid which is to be evaporated. Thus, the quantity of developer generated in the troughs, preferably ammonia, is determined by the initial concentration and quantity of the developer liquid. The gaseous developer medium is discontinuously generated when a portion of developer liquid is supplied by the bucket conveyor.

Further, U.S. Pat. No. 2,047,104, discloses an apparatus for developing photoprints with a developer chamber in which a preferably inclined evaporating channel is arranged. A tube is attached to the lower end of the evaporating channel in order to remove any residual developer liquid not evaporated by the heat generated by the heating elements arranged beneath the channel. The developer vapor is contacted with the material to be developed through a perforated guide plate. The liquid evaporated in the evaporating channel is replaced by adding a new supply from a dropper. Normally, the developer liquid is immediately evaporated. If, due to improper handling, some of the liquid should reach the lower end of the channel, it is immediately removed through the pipe so that no sump can form in the channel.

The apparatus just described has fundamentally the same disadvantages as the apparatus first above mentioned. In particular, gaseous developer medium is discontinuously generated in the channel only if a drop is added by the dropper. Thus, it is not assured that uniform quantities of gaseous developer medium are generated.

The present invention produces gaseous developer medium in the desired constant quantities per unit of time in order to ensure uniform development within a minimum of time, with the water vapor content of the developer medium being as high as possible. The apparatus used for this purpose is distinguished by an uncomplicated design and reliable operation.

Other than in the case of the hitherto used variable, but fixedly adjusted heating element, it is achieved, by providing a temperature sensor, which is connected by a thermostat with the heating element in the open evaporator, that constant quantities of vaporous developer medium are generated practically independently of the quantity of solution fed per unit of time. The principle that the partial pressure of the vapors generated by the evaporator is merely a function of the temperature within the evaporator is utilized for this purpose. In the developing apparatus according to the invention, the quantity of gaseous developer medium generated per unit of time is controlled very accurately and with relatively inexpensive means.

Whereas, in the developing devices comprising a heating element which can be set only to or adjusted to constant heat outputs, the temperature of the developer solution adjusts itself to random values, depending upon the quantity of solution introduced per unit of time, and the heating element is cooled to varying degrees, similarly depending upon the quantity of developer solution introduced, thus causing variations in the quantity of water vapor which is generated when heating aqueous ammonia, and has a considerable influence on the developing speed, the apparatus according to the present invention including an evaporator achieves a quick and particularly uniform development, independently of the quantity of developer medium supplied per unit of time.

The generation of vapor is accurately adjusted by arranging the temperature sensor heating element within the evaporator trough, below the opening or openings of the outlet. In this manner, the heating element is completely surrounded by the developer solution during operation and thus heats only the developer solution and not the surroundings.

Preferably, a 25 percent by weight aqueous solution of ammonia is used which is heated in the area of the outlet to a temperature preferably between 60° and 100° C.

By regulating the level, which is less expensive than regulating the flow, it is achieved that, on the one hand, the level of the developer solution in the evaporator does not fall below a certain predetermined value, in particular that the level of the developer solution does not fall as low as the heating element or even down to the temperature sensor or below. On the other hand, by appropriate adjustment of the level regulator, it may be achieved that only a relatively small quantity of developer solution leaves the evaporator chamber through the outlet after having passed through the evaporator chamber. The regulation of the level is not critical, because it is impossible for the surface of the developer solution to rise above the outlet opening or openings. It is reliably avoided, however, that the temperature sensor is no longer surrounded by developer solution and thus signals the ambient temperature to the thermostat. Inasmuch as will be explained further below, the ambient temperature preferably is adjusted to a higher temperature than the developer solution, this would cause the heat output of the heating element in the evaporator trough to be reduced and the quantity of developer medium generated would be insufficient.

For the reasons outlined above, the level regulator in the developing apparatus of the invention preferably is so adjusted that the level of developer solution corresponds to the level of the opening or openings of the outlet in the evaporator trough.

In a particularly advantageous embodiment of the invention, the evaporator trough is completely open and the largest possible quantity of vaporous developer medium per unit of time is generated at any given heat output. By means of a partition, two compartments or chambers are formed which urge the developer solution along a long path through the developer trough so that the vaporous developer medium is generated with the highest degree of uniformity and without sudden heating of the solution.

In one embodiment of the developing apparatus, the developer solution flows through the inlet into one of the compartments. From there, it can flow only into the other compartment through the overflow between the compartments and then to the outlet. Inasmuch as the heating element and the temperature sensor are arranged near the outlet, the developer solution leaving the evaporating trough has the highest temperature. This temperature decreases constantly towards the inlet opening. The developer solution, preferably an aqueous ammonia solution, is thus heated least in the area of the highest ammonia concentration and most in the area of the lowest ammonia concentration. In this manner, the quantity of ammonia generated along this path is substantially constant. If the elongated open evaporating trough is arranged in the developing chamber transversely to the direction in which the light-sensitive material to be developed is conveyed, it is thus ensured that uniform developing results are obtained across the width of the material. The spent developer solution leaving the outlet opening as waste water after passage through the evaporating trough thus has only a low ammonia concentration.

Further, it is of advantage if the developing apparatus in which an evaporator is arranged in the developing chamber is so designed that the developing chamber contains an additional heating element. By providing an additional heating element in the evaporating chamber, the temperature may be adjusted so that it is higher than the temperature of the developer solution in the evaporating trough, in order to avoid undesirable condensation of the developer medium generated, especially in the areas where the material to be developed is in contact with guide means in the developing chamber. In this manner, the drawbacks may be avoided which hitherto required the removal of the liquid phase as quickly as possible from the developing chamber.

In the following, one embodiment of the invention will be further described with reference to the accompanying drawing:

In the drawing, the numeral 1 designates a developing chamber through which a sheet of light-sensitive material 2 is transported, in the direction *2a*, for development. A double trough 3 containing two compartments *3a* and *3b* is arranged at the bottom of the developing chamber. The double trough 3 includes a partition 5 between the two inclined side walls *4a* and *4b*. The partition is so joined to the front wall 6 (shown partially broken away) that the connection is impervious to liquids, whereas it is spaced from the end wall 7, thus leaving a communicating space 8 between the two compartments.

A tubular inlet *8a* into the compartment *3a* is arranged beside the front wall 6. In the compartment *3b*, a similar tubular outlet 9 with an opening *9a* is arranged beside the same front wall 6. The opening *9a* is positioned at a distance from the bottom 10 of the double trough 3, but below the upper edge of the partition 5. The bottom of the trough may be completely flat and need not be inclined.

A dosing pump 12 is provided in the pipe 11 leading to the inlet *8a*. The dosing pump 12 is in connection with a container 13 in which the developer solution is stored. The dosing pump 12 is controlled by a level regulator 14 which receives its signal from a level indicator 15.

Further, a rod-shaped heating element 16 is arranged in the second compartment *3b*, parallel to the longitudinal direction of the compartment. The heating element is arranged below the level of the opening *9a* of the outlet. Near the outlet and also below the level thereof, a temperature sensor 17 is provided in the second compartment *3b* which is connected to the input of a thermostat 18. The desired value of the thermostat may be adjusted by means of a setting means 19. A heating element 20 used for heating the evaporating chamber is arranged above the double trough, but below the path of the light-sensitive material 2 to be developed. The heating element is controlled by a control device 21 with an adjuster 22.

The setting means 19 for the temperature of the developer solution in the double trough is so adjusted that the desired quantity, per unit of time, of vaporous developer medium is generated. The adjuster 22 for the temperature within the evaporating chamber of the developing chamber is set to a temperature approximately 2 to 10° Centigrade above the temperature of the developer solution near the outlet opening *9a*, in order to avoid condensation. The level regulator 14 is so adjusted that, at the temperature conditions prevailing in the double trough, the level of the developer solution can drop only temporarily and insignificantly below the level of the opening *9a* of the outlet 9, and that, on the other hand, the quantities of developer solution leaving the outlet in the form of waste water do not exceed a certain value.

If the parameters are adjusted in such a manner, the developer solution introduced through the inlet *8a* is constantly heated during its passage through the first compartment, from the front wall 6 to the end wall 7 opposite, and is further constantly heated until it reaches the opening 9*a* of the outlet 9. Any spent developer solution leaving the outlet 9 in the form of waste water contains only relatively small quantities of ecologically hazardous components, especially ammonia. The developer vapor used as the developer medium, which is constantly and uniformly generated and evenly distributed over the width of the light-sensitive material to be developed, is additionally heated by the heating element 20 before it contacts the light-sensitive material and the guide elements (not shown in the drawing). The quantity of developer solution evaporated is replenished in accordance with the level indicator 15, so that it is practically impossible for the level of the developer solution in the double trough to drop below the level of the outlet opening 9*a*.

In this manner, a rapid development of consistently good quality of the light-sensitive material passing through the developing chamber is achieved.

It will be obvious to those skilled in the art that many modifications may be made within the scope of the present invention without departing from the spirit thereof, and the invention includes all such modifications.

What is claimed is:

1. A developing apparatus for light-sensitive material comprising elongated open trough means, partition means in said trough means dividing said trough means into sections, means providing communication between said sections, inlet and outlet means for said trough means, said inlet means being adapted to introduce solution into one of said sections and said outlet means being adapted to remove solution from another of said sections, heating means in said section containing said outlet means and being positioned below an opening of said outlet means in said trough means, and temperature sensor means so positioned near said outlet means and within said trough means that, in operation, it is wholly immersed in the solution, said temperature sensor means being connected to said heating means via thermostat means.

2. A developing apparatus according to claim 1 including level indicator means connected via level regulating means with dosing means, whereby additional solution is supplied to the trough means by said dosing means when a solution level in said trough means drops below a predetermined value.

3. A developing apparatus according to claim 2 in which said level regulating means operates such that said solution level corresponds to said opening of said outlet means in said trough means.

4. A developing apparatus according to claim 1 in which said inlet means is near one end wall of one of said trough means sections, said outlet means and temperature sensor means being near said end wall but in another of said sections, which also houses said heating means, and said means providing communication between said sections is at an opposite end wall of said trough means.

5. A developing apparatus according to claim 1 including chamber means enclosing said trough means, said trough means having approximately the same width as light-sensitive material to be developed.

6. A developing apparatus according to claim 5 including an additional heating means above said trough means.

* * * * *